US005778477A

United States Patent [19]

Conway

[11] Patent Number: 5,778,477

[45] Date of Patent: Jul. 14, 1998

[54] TOOTHBRUSH

[76] Inventor: Raymond Conway, 710 Huntington Ave., Pine Beach, N.J. 08741

[21] Appl. No.: 839,487

[22] Filed: Apr. 14, 1997

[51] Int. Cl.[6] ..... A46B 9/04

[52] U.S. Cl. ..... 15/167.1; D4/104

[58] Field of Search ..... 15/167.1, 201; D4/104

[56] References Cited

U.S. PATENT DOCUMENTS

| | | | |
|---|---|---|---|
| D. 96,749 | 9/1935 | Hellonen | D4/104 |
| 1,639,880 | 8/1927 | Butler | 15/167.1 |
| 1,951,050 | 3/1934 | Grafinger | 15/167.1 |
| 2,114,947 | 4/1938 | Warsaw | 15/167.1 |
| 2,123,407 | 7/1938 | Dullea | 15/167.1 |
| 3,732,973 | 5/1973 | Crawford | 15/167.1 X |
| 4,800,608 | 1/1989 | Key | 15/167.1 |
| 5,046,212 | 9/1991 | O'Conke | 15/167.1 X |
| 5,371,915 | 12/1994 | Key | 15/167.1 |
| 5,373,602 | 12/1994 | Bang | 15/201 X |

FOREIGN PATENT DOCUMENTS

| | | | |
|---|---|---|---|
| 2652245 | 3/1991 | France | 15/167.1 |
| 388182 | 1/1924 | Germany | 15/167.1 |
| 655526 | 1/1938 | Germany | 15/167.1 |
| 56-171728 | 12/1981 | Japan | 15/167.1 |
| 671866 | 10/1989 | Switzerland | 15/167.1 |
| 304459 | 1/1921 | United Kingdom | 15/167.1 |

*Primary Examiner*—Mark Spisich
*Attorney, Agent, or Firm*—Clifford G. Frayne

[57] ABSTRACT

The present invention relates to a toothbrush having two brush head surfaces in angular relationship to each other, the second brush head surface angled in relationship to the first brush head surface to accommodate the inner curvature of the jaw and to permit the efficient cleaning of the back teeth.

1 Claim, 2 Drawing Sheets

TOOTHBRUSH

BACKGROUND OF THE INVENTION

1. Field of the Invention

The present invention relates to a toothbrush and more particularly, to a toothbrush having an oblique bristle extension to aid in the cleaning of the back molars and jaw.

2. Description of the Prior Art

Generally speaking, toothbrushes are manufactured by implanting the bristle bases on the brush head portion of a toothbrush, the opposing end of the toothbrush comprising the handle. Currently, toothbrushes have generally developed a configuration comprising a straight handle portion or one which is ergometrically designed with a brush head secured thereto at an oblique angle. However, these toothbrushes cannot effectively clean the rear molars of the teeth within the jaw without being obstructed by the jaw.

This efficacy of cleaning is further compounded where an individual, like the inventor herein, has his wisdom teeth. No toothbrush presently available or known to the undersigned provides for an efficient and effective manner of reaching and cleaning these rear teeth and inner jaw.

Applicant is aware of U.S. Pat. No. 5,373,602 to Bang which discloses a toothbrush for minimizing scratching of the periodontal tissue and still allows for the cleaning of the back teeth; however, the structure of the toothbrush as disclosed by Bang differs substantially from that of Applicant. The same holds true for U.S. Pat. No. 2,123,407 to Dullea which is essentially a toothbrush having double sided bristles.

U.S. Pat. No. 1,951,050 to Grafinger discloses a toothbrush for cleaning dentures which again differs in structure from Applicant's invention and is not related to the function of Applicant's toothbrush. Similarly, Design Patent 322,171 to Grunberg discloses a denture brush for cleaning dentures when they are removed from the oral cavity.

Applicant's invention provides for the structure of a toothbrush and in particular the bristle and brush portion, which allows for the access to the rear molars and the efficient cleaning thereof.

OBJECTS OF THE INVENTION

It is an object of the present invention to provide for a novel toothbrush which allows access to the rear molars of the teeth.

Another object of the present invention is to provide for a novel toothbrush having a handle and bristle design which permits the efficient cleaning of the rear molars in the jaw.

A still further object of the present invention is to provide for a novel toothbrush wherein a portion of the bristle portion of the toothbrush can be flexibly hinged to provide for greater efficacy in the cleaning of the rear molars within the jaw.

SUMMARY OF THE INVENTION

A toothbrush having a handle portion and a first bristle portion, the first bristle portion having a first angular portion in relationship to the handle portion, the first bristle portion having an angular relationship to a second bristle portion for contact with the rear most molars within the jaw, there being a continuous plurality of bristles from the commencement of the bristles on the first bristle portion to the termination point of the second bristle portion.

BRIEF DESCRIPTION OF THE DRAWINGS

The present invention will become more fully understood from the detailed description given here below taken with the accompanying drawings which are given by way of illustration only and thus are not limitive of the present invention and wherein.

DETAILED DESCRIPTION OF THE DRAWINGS

Figure 1:
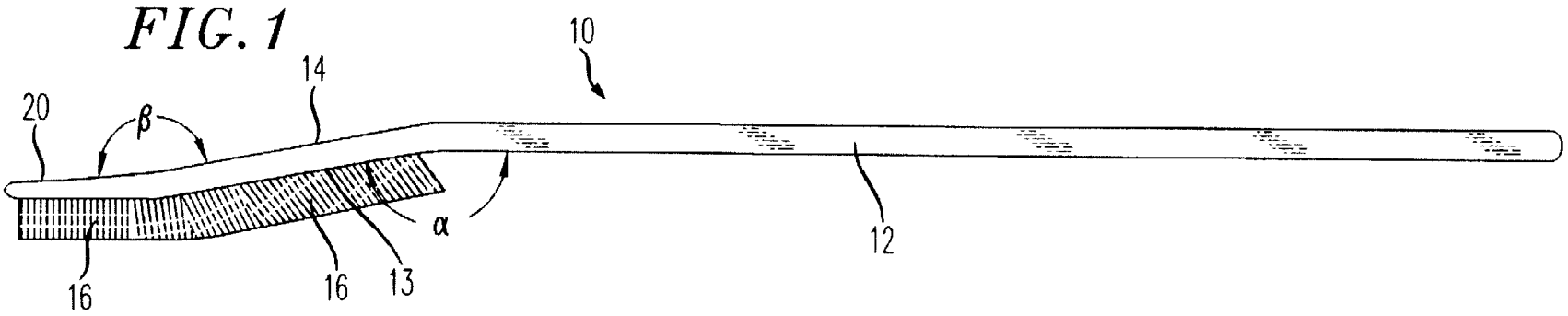
FIG. 1 is a side view of the toothbrush according to the present invention.
Figure 2:
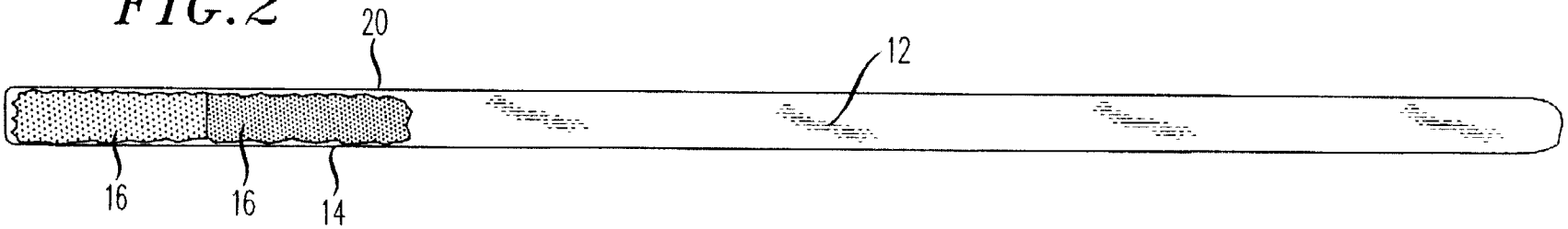
FIG. 2 is a top view of the toothbrush according to the present invention.
Figure 3:
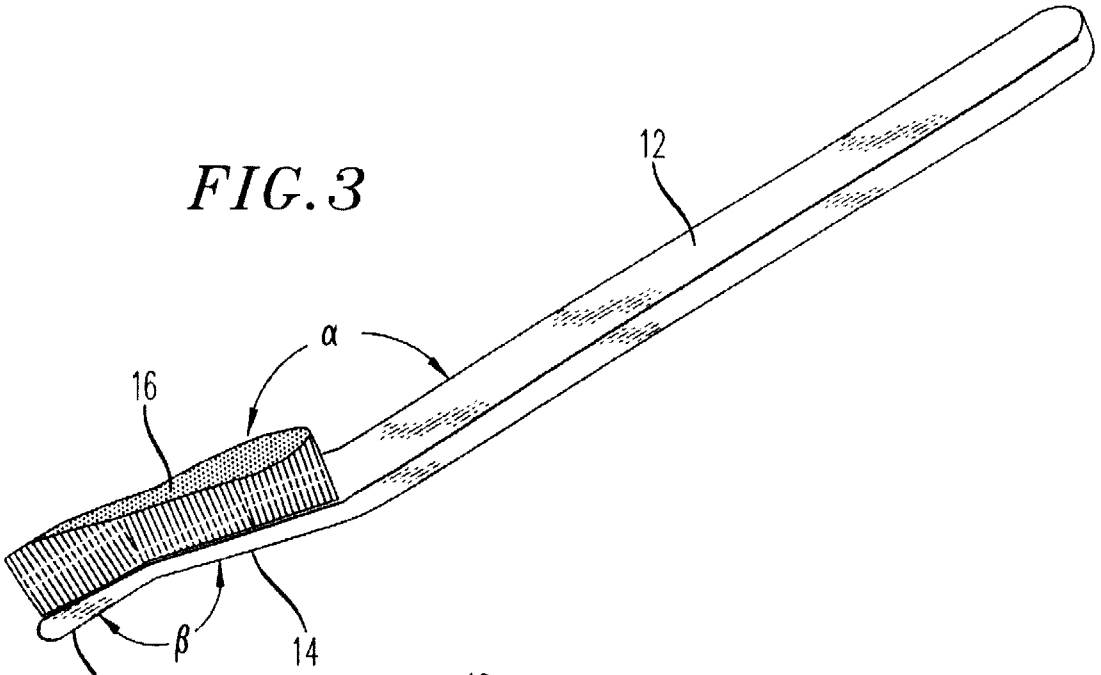
FIG. 3 is a perspective view of the toothbrush in accordance with the present invention.

Referring now in detail to the drawings for the purpose of illustrating the preferred embodiments of the present invention, the toothbrush 10 as shown in FIGS. 1, 2 and 3 comprises a handle portion 12 which is generally planar and straight in construction. It will be noted by those of ordinary skill in the art that the handle may have a degree of curvature as toothbrushes constantly strive to obtain an ergometric design for fitting within the hand of the user and allowing access with the brush head to the teeth within the jaw. Secured to one end of the handle is a brush head portion 14 which is normally formed in unitary construction with the handle. In the embodiment shown, the brush head portion 14, as is common with many toothbrushes, forms an oblique angle a with handle portion 12. In normal construction, there would be a plurality of bristles 16 extending from the inner planar surface 18 of brush head portion 14, inner planar surface 18 being defined as that portion of the brush head 14 forming the oblique angle a with the handle 12. The plurality of bristles 16 extend vertically from brush head portion 14 and would be embedded therein. In this construction, the oblique angle a formed between brush head portion 14 and handle 12 is designed to allow the user to manipulate the brush head portion 14 within the mouth at a complimentary angle with the curvature of the jaw and the teeth secured thereto.

Applicant's contribution consists of a second brush head portion 20 which, in the first embodiment, is formed in unitary construction with handle portion 12 and first brush head portion 14 to form an oblique angle b with first brush head portion 14, oblique angle b formed on the opposing side of the toothbrush 10 from oblique angle a. Second brush head portion 20 also has secured thereto a plurality of bristles 16 embedded within second brush head portion 20 and extending substantially perpendicularly thereto in second brush head portion 20.

In the transition area, as that area defined by oblique angle b between first brush head portion 14 and second brush head portion 20, the bristles would be embedded in the transition area in a configuration which would not be vertically perpendicular to first brush head portion 14 and second brush head portion 20, but would be so positioned angularly that there would be no gap between the bristles embedded in first brush head portion 14 and the bristles embedded in second brush head portion 20 and would thus provide for a continuous level of bristle ends extending from the commencement of first brush head portion 14 to the end tip 22 of second brush head portion 20. See FIG. 5.

In this configuration, the bristles secured to first brush head portion 14 would be utilized in the normal manner for the brushing of the teeth easily reachable by this portion of the toothbrush 10. The plurality of bristles secured to second brush head 20 would be utilized to reach the rear-most molars and wisdom teeth for cleaning and would contribute to the efficacy of such cleaning. The oblique angle (b) between first brush head portion 14 and second brush head portion 20 permits the user to impart greater bristle contact on the rearward molars and wisdom teeth then allowed just by using first brush head portion 14.

Oblique angle a formed between handle portion 12 and first brush head portion 14 is variable and is dictated by measurement standards developed by the dental arts vis-a-vis the size of the jaw and the age of the person and may vary from toothbrush to toothbrush depending upon the manufacturer, the age of the user and the like. Similarly, oblique angle b may vary from toothbrush to toothbrush depending upon the age of the user, but realizing that most individuals who retain their wisdom teeth do not actually have their wisdom teeth until their late teenage years.

Figure 4:
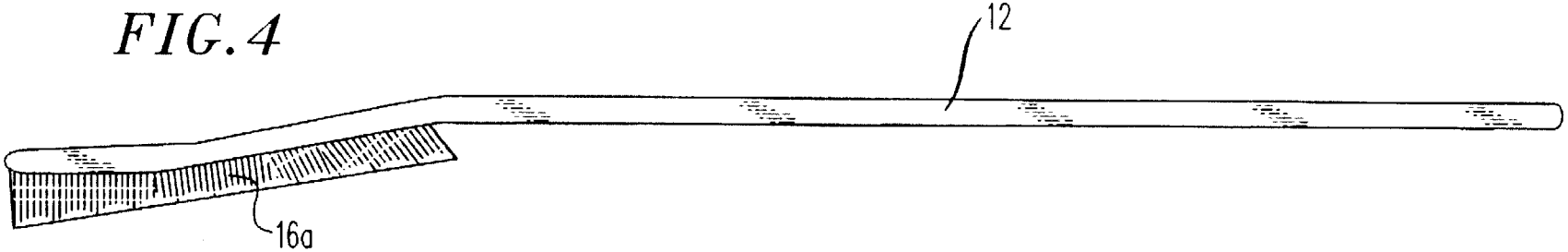
FIG. 4 is a side view of a second embodiment of the toothbrush in accordance with the present invention.

FIG. 4 illustrates a second embodiment of toothbrush 10 which is identical to the first embodiment of toothbrush 10 as illustrated in FIGS. 1, 2 and 3 as it relates to the handle portion 12, first brush portion 14 and second brush portion 20. The difference in the second embodiment, as illustrated in Figure 4, is that the bristles 16a are not all of equal length. In the second embodiment, the bristles commencing at oblique angle (a) would be of a continuous length along first brush head portion 14. In the transition zone defined by oblique angle (b), the bristles would remain embedded in the portion of brush head portion 14 and second brush head portion 18, such that the bristles would be perpendicularly parallel to those bristles embedded in first brush head portion 14, but would extend in length to their termination point at end tip 22 on second brush head portion 20. In this configuration, all of the bristles would be in parallel arrangement with each other, but the bristles at end tip 22 of second brush head portion 20 would be longer than those bristles commencing on first brush head portion 14 at oblique angle (a). This second embodiment is illustrated as a possible easier means of fabricating a toothbrush 10 which still contains a second brush head portion 20 with bristles secured thereto for the cleaning of the rear-most molars and wisdom teeth within the jaw.

Figure 5:
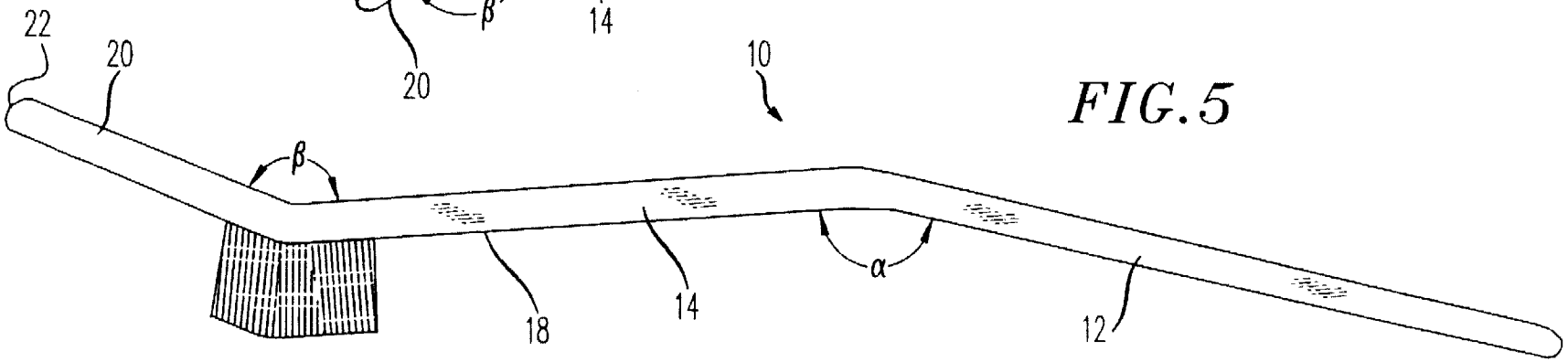
FIG. 5 is a side, closeup view of the bristle portion of the toothbrush of the first embodiment.

FIG. 5 is a side closeup view of the first embodiment of the toothbrush showing the configuration of the bristles 16 in relationship to oblique angle b between brush portion 14 and brush portion 20. This is illustrated to show that there is a continuity with the bristles and no gap as a result of forming of oblique angle b on the brush portion.

Additionally, second brush head portion 20 is illustrated as being rigidly secured to first brush head portion 14. However, second brush head portion 20 could also be fabricated from a flexible material and still be secured to first brush head portion 14. This flexibility imparted at angle b would promote even further efficacy in cleaning the rear molars.

While the present invention has been illustrated with respect to a toothbrush which would be manipulated manually by the user, the same structure could be incorporated with respect to a mechanical toothbrush operating off of rechargeable batteries.

While the present invention has been described in connection with the exemplary embodiments thereof we understood that many modifications will be apparent to those with ordinary skill in the art and that the application is sent to cover any adaptations or variations thereof. Therefore it is manifestly intended that this invention be only limited by the claims and the equivalents thereof.

I claim:

1. A toothbrush comprising;

an elongated handle;

a first brush head integrally and rigidly fixed to said handle in angular relationship therewith, said first brush head having an inner and outer planar surface, said angular relationship being an obtuse angle formed between said elongate handle and said inner planar surface of said first brush head;

a second brush head integrally and rigidly fixed to said first brush head in an angular relationship therewith, said second brush head having an inner and outer planar surface, said angular relationship being an obtuse angle formed between said outer planar surface of said second brush head and said outer planar surface of said first brush head;

a plurality of bristles affixed to said inner planar surface of said first brush head and said inner planar surface of said second brush head, said plurality of bristles on said first brush head and said second brush head being in parallel relationship, said plurality of bristles on said first brush head being of uniform length, said plurality of bristles on said second brush head increasing in length from the connection between said first brush head and said second brush head to the tip of said second brush head, the tips of said bristles of said first brush head and said second brush head terminating in a plane parallel to said first brush head.

* * * * *